US007764887B2

(12) United States Patent
Kasai

(10) Patent No.: US 7,764,887 B2
(45) Date of Patent: Jul. 27, 2010

(54) DEVELOPING DEVICE AND IMAGE FORMING APPARATUS

(75) Inventor: Tadashi Kasai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 191 days.

(21) Appl. No.: 11/737,417

(22) Filed: Apr. 19, 2007

(65) Prior Publication Data

US 2007/0253720 A1 Nov. 1, 2007

(30) Foreign Application Priority Data

Apr. 26, 2006 (JP) ..... 2006-122117
Jul. 27, 2006 (JP) ..... 2006-205370

(51) Int. Cl.
*G03G 15/08* (2006.01)

(52) U.S. Cl. ..... 399/27; 399/254; 399/256

(58) Field of Classification Search ..... 399/27, 399/119, 254, 255, 256, 259, 272, 281
See application file for complete search history.

(56) References Cited

U.S. PATENT DOCUMENTS

| | | | | |
|---|---|---|---|---|
| 6,887,636 | B2 | 5/2005 | Matsuda et al. | |
| 6,899,986 | B2 | 5/2005 | Aoki et al. | |
| 6,934,484 | B2 | 8/2005 | Suzuki et al. | |
| 7,125,638 | B2 | 10/2006 | Suzuki et al. | |
| 7,162,187 | B2 | 1/2007 | Koichi et al. | |
| 2004/0247329 | A1 * | 12/2004 | Ito et al. | 399/12 |
| 2005/0025508 | A1 * | 2/2005 | Karakama et al. | 399/27 |
| 2005/0030595 | A1 | 2/2005 | Koichi et al. | |
| 2005/0079430 | A1 | 4/2005 | Aoki et al. | |
| 2005/0117919 | A1 * | 6/2005 | Ito et al. | 399/27 |
| 2006/0029435 | A1 | 2/2006 | Kasai et al. | |
| 2006/0275688 | A1 | 12/2006 | Suzuki et al. | |

FOREIGN PATENT DOCUMENTS

| | | |
|---|---|---|
| JP | 6-348134 | 12/1994 |
| JP | 2002-182474 | 6/2002 |
| JP | 2003-270933 | 9/2003 |
| JP | 2003-280356 | 10/2003 |
| JP | 2005-181896 | 7/2005 |
| JP | 2005-227316 | 8/2005 |

OTHER PUBLICATIONS

U.S. Appl. No. 12/203,422.*
Machine translation of JP2003-270933 by Shinji Tamaki et al. dated Sep. 2003.*

* cited by examiner

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

A developing device includes a developing roller that supplies two-component developer from a developer container to an image carrier, and a first developer supplying unit and a second developer supplying unit arranged in parallel, one closer to the developing roller than the other is to the developing roller. The first developer supplying unit and the second developer supplying unit circularly convey the two-component developer while stirring the two-component developer to supply the two-component developer to the developing roller. The first developer supplying unit and the second developer supplying unit supply different amounts of the two-component developer.

9 Claims, 7 Drawing Sheets

DEVELOPING DEVICE AND IMAGE FORMING APPARATUS

CROSS-REFERENCE TO RELATED APPLICATIONS

The present document incorporates by reference the entire contents of Japanese priority documents, 2006-122117 filed in Japan on Apr. 26, 2006 and 2006-205370 filed in Japan on Jul. 27, 2006.

BACKGROUND OF THE INVENTION

1. Field of the Invention

The present invention relates to a developing device, and an image forming apparatus.

2. Description of the Related Art

In an image forming apparatus, such as a copier, a printer, a facsimile machine, or a printer, an electrostatic latent image formed on a photosensitive member as an image carrier is visualized by a developing device to obtain a visible image, and the visible image is transferred onto a sheet and output.

Some image forming apparatuses have such a configuration that one photosensitive member is provided for only a single color, and others have such a configuration that a plurality of photosensitive members are provided to form an image of a plurality of colors. The latter configuration is used to form a multicolor image including a full-color image.

Meanwhile, developers for use in development include a one-component developer containing only a magnetic or non-magnetic toner and a two-component developer with a toner and a carrier being mixed therein.

The two-component developer includes a toner and a carrier that carries the toner. The toner is charged through frictional electrification caused by stirring and mixing to be in a state in which the toner can be electrostatically attached to the electrostatic latent image on the photosensitive member.

Japanese Patent Application Laid-Open No. 2003-270933, for example, discloses a developing device that supplies a two-component developer. The conventional developing device includes rotatable screw augers as first and second developer supplying units. The first and second developer supplying units are arranged in parallel from a position close to a developing roller disposed near a photosensitive member as an electrostatic-latent-image carrier in a developer container that contains the developer.

In the conventional developing device, one of the first and second screw augers that is near the developing roller supplies the developer to the developing roller as a main function, whilst the other one that is located away from the developing roller stirs new toner and carrier supplied to the storage unit for mixing as a main function.

Therefore, the first developer supplying unit is required to ensure a sufficient amount of drawn-up developer for the developing roller. The second developer supplying unit is required to keep an appropriate mixing ratio between the toner and the carrier to be stirred so as not to deteriorate a charging characteristic of the toner.

However, if the fluidity of the developer is decreased with time or the density of the toner is increased (abnormality in the supply amount occurs), an exchange of the developer between the first and second screw augers may become uneven (the balance of the supply amount of the developer between the screw augers is disturbed), which causes an abnormal image. That is, if the developer is decreased at the screw auger located near the developing roller, the amount of the developer to be drawn up is decreased, resulting in deterioration in image density and unevenness in development due to nonuniformity of the amount of the developer carried on the developing roller (stripes according to a screw pitch of the screw auger and unevenness in density).

Conversely, if the developer is increased at the screw auger located away from the developing roller, the fluidity may be decreased, which causes unevenness in density and an increase in density deviation.

It has been generally known that toner supply control is performed by forming a test pattern or the like through development and, based on the density of the test pattern, determining the density of the developer. However, management of the amount of developer and its deviation state in the developing device is not performed, and it is often the case that only the management control over the developer with the test pattern is performed, and management of the balance of the actual supply amount has not yet been performed. Moreover, even if the balance is disturbed, there is no solution to this problem under the present circumstances.

Many models of electrophotography devices in recent years have adopted a two-component development scheme using a powder toner and a carrier. Reasons for this include high durability and high responsivity to speedup, and that is why this scheme has been widely spread.

However, unlike the one-component development scheme, this scheme requires a mechanism for evenly mixing the toner and the carrier. Therefore, various contrivances are provided to the developing device of the two-component development scheme.

For example, a stirring member is provided to efficiently mix the toner and carrier, or a toner supply position is changed or a conveyor route is increased so as to increase the time of mixing the developer. More specifically, for example, a two-axis conveying scheme using two conveyor screws has been widely known and spread.

FIG. 13 is a schematic diagram of a general developing device 2 of a two-component developing system. The developing device is explained as having a typical configuration including two screws and one developing roller. However, the developing device is not meant to be restricted to such a configuration.

The developing device 2 includes a developing roller 3 and two developer conveyor screws 14 and 15. Of these developer conveyor screws 14 and 15, the one closer to the developing roller 3 is called a first developer conveyor screw 14 and the other closer to a toner supply opening (not shown) is called a second developer conveyor screw 15.

On the developer conveyor screws 14 and 15, a two-component developer containing a toner and a carrier is input in an evenly mixed state, and is circulated as being stirred between the two developer conveyor screws 14 and 15. This is a contrivance to efficiently stir the toner input from the toner supply opening provided at an end of the second developer conveyor screw 15.

In a one-axis conveyance scheme not depicted, the developer is drawn up by the developing roller to form an ear of the developer by a magnet incorporated in the developing roller. The ear strokes the surface of the photosensitive member opposing thereto with a predetermined distance being kept, thereby developing the toner onto the photosensitive member through an applied developing bias.

In the two-axis conveyance scheme explained above, ideally, the first developer conveyor screw 14 has a sufficient amount of developer to be sufficiently drawn up by the developing roller, and the second developer conveyor screw 15 has a sufficient amount required for stirring the toner supplied for achieving the original purpose and the developer.

For example, Japanese Patent Application Laid-Open Nos. 2003-270933 and 2005-227316 have proposed technologies related to the two-axis conveyor scheme for developer. Those technologies aim at ideally supplying to the first developer conveyor screw on a developer sleeve side a sufficient amount of developer to be drawn up by the developing roller and supplying to the second developer conveyor screw a sufficient amount of developer required to stir the toner and the developer.

Japanese Patent Application Laid-Open No. 2003-270933 describes that, in order to reduce stress onto the toner, a developer conveyor screw and a developing roller can be drive-controlled at arbitrary timing. In the conventional technology, rotation is stopped in order to reduce a developer stirring time as much as possible other than the developing operation. Japanese Patent Application Laid-Open No. 2005-227316 describes that, in order to start up the developer in a short time, a developer conveyor screw is driven earlier than usual at the time of power-on or recovery from sleep.

However, in the conventional technology explained in connection with FIG. 13, because of a decrease in fluidity of the developer with time, an increase in the amount of developer due to an increase in density of the toner, and the like, an appropriate balance of the amount of developer between the first and second developer conveyor screws 14 and 15 may be often decreased. With such a state, there is a problem of occurrence of an inconvenience on the image.

When the developer on the first developer conveyor screw 14 side is decreased, the amount of drawing up by the developing roller 3 is decreased, thereby causing a decrease in image density and a screw-pitched abnormal image.

Conversely, when the developer on the first developer conveyor screw 14 side is increased, fluidity is decreased, thereby causing unevenness in density on the right and left sides of the image and an increase in image density deviation in a page. Moreover, since the amount of developer and the state of deviation cannot be known from outside, only the abnormal image has to be used for determination. Therefore, there is no solution even when any problems explained above occur.

SUMMARY OF THE INVENTION

It is an object of the present invention to at least partially solve the problems in the conventional technology.

According to an aspect of the present invention, a developing device includes a developer container that contains two-component developer including carrier and toner attached to the carrier through frictional electrification, a developing roller that supplies the two-component developer from the developer container to an image carrier, a first developer supplying unit, and a second developer supplying unit that is aligned with the first developer supplying unit and located more distant from the developing roller than the first developer supplying unit is from the developing roller. The first developer supplying unit and the second developer supplying unit circularly convey the two-component developer while stirring the two-component developer to supply the two-component developer to the developing roller. The first developer supplying unit supplies a first amount of two-component developer, and the second developer supplying unit supplies a second amount of two-component developer different from the first amount.

According to another aspect of the present invention, a developing device includes a developing roller that carries developer consisting of two component, a developer container that contains the developer, a first rotating member that is located near the developing roller in the developer container, a second rotating member that is located more distant from the developing roller than the first rotating member is from the developing roller, a first adjusting unit that deforms to adjust supply of the developer from the first rotating member to the second rotating member, and a second adjusting unit that deforms to adjust supply of the developer from the second rotating member to the first rotating member. The first rotating member and the second rotating member circularly convey the developer while stirring the developer in the developer container to supply the developer to the developing roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. In the following, the present invention is explained taking as an example a tandem-type color printer capable of forming a full-color image. The image forming apparatus is not meant to be restricted to such a printer, but can be a copier, a facsimile machine, a printer, and the like.

Figure 1:
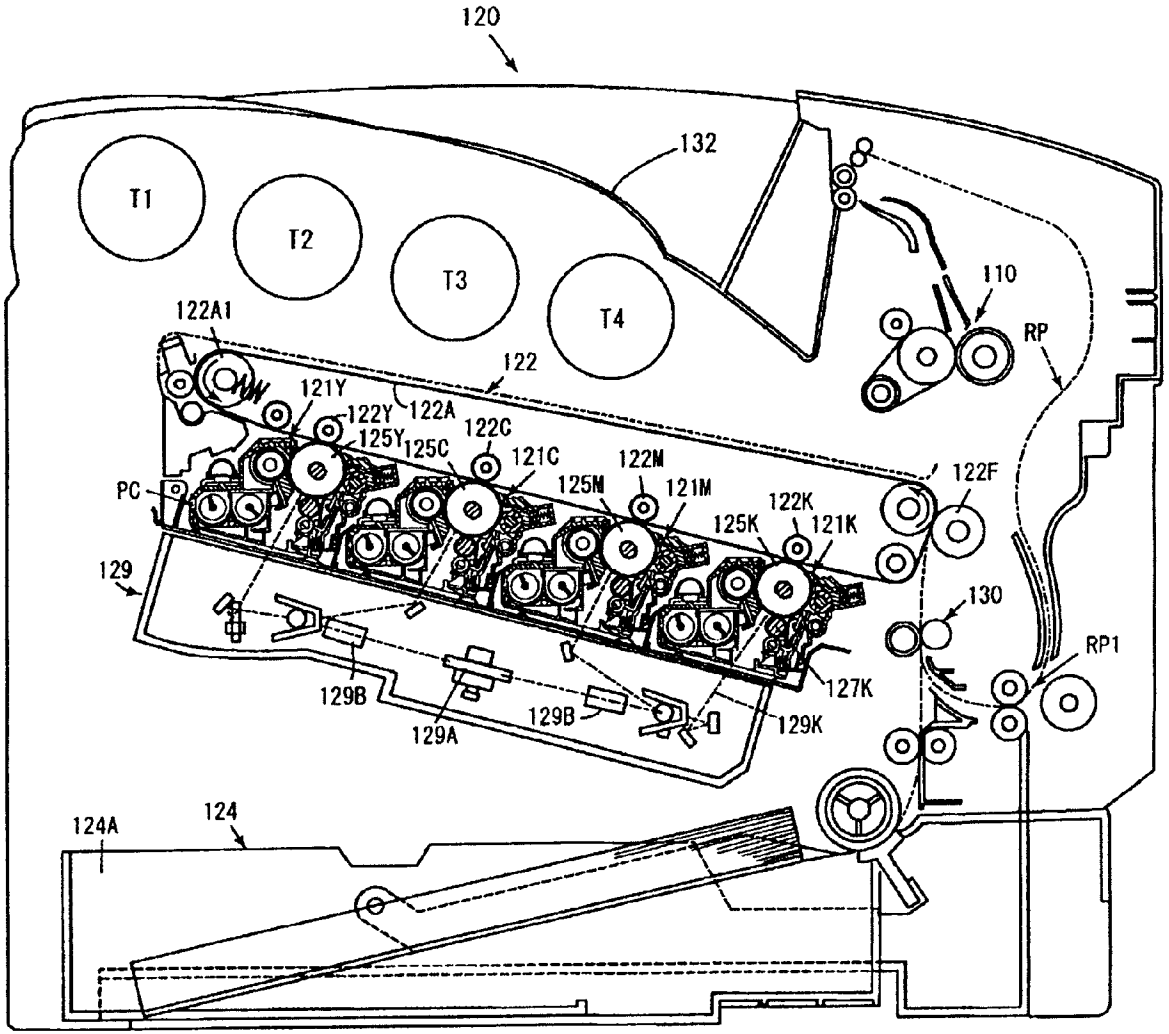
FIG. 1 is a schematic diagram of an image forming apparatus according to a first embodiment of the present invention.

FIG. 1 is a schematic diagram of an image forming apparatus 120 according to a first embodiment of the present invention. The image forming apparatus 120 includes image forming devices 121Y, 121C, 121M, and 121K, a transfer device 122, a feeding tray (not shown), a feeding cassette 124A, a resist roller 130, and a fixing device 110.

The image forming devices 121Y, 121C, 121M, and 121K each form an image for a relevant color according to an original image. The transfer device 122 is located opposite to each of the image forming devices 121Y, 121C, 121M, and 121K. The feeding tray and the feeding cassette 124A are mounted on a feeding device 124 as supplying units that supply a recording medium to a transfer area opposed to the transfer device 122. The resist roller 130 supplies a recording medium conveyed from the feeding tray or the feeding cassette 124A at an image formation timing by the image forming devices 121Y, 121C, 121M, and 121K. The fixing device 110 fixes an image on a sheet-like recording medium in the transfer area after transfer.

In the fixing device 110, although not explained in detail, a belt fixing scheme is used including a fixing roller and a pressure roller that are opposed to each other and a fixing belt spread over each of the fixing roller and the heating roller. With the fixing belt heated by a heating roller being in contact with a sheet passing through a fixing nip portion formed by the fixing roller and the pressure roller, thereby melting an unfixed toner image through heat and pressure for fixing through penetrating action. The configuration of the fixing device 110 can be of a heat roller fixing scheme using rollers for heating and pressure instead of using a belt.

In the transfer device 122, a belt spread over a plurality of rollers as a transfer member (hereinafter, a transfer belt) 122A is used. At positions opposing to photosensitive drums of the respective image-forming devices, transfer bias units 122Y, 122C, 122M, and 122K which apply the transfer bias are disposed. With a transfer bias having a polarity reverse to that of the toner being activated, toner images formed by the respective image forming devices are sequentially superposed for transfer.

In the transfer device 122, a secondary transfer bias unit 122F for collectively transferring the toner images superposed for transfer on the transfer belt 122A is disposed on a conveyor route of a recording medium.

The image forming devices 121Y, 121C, 121M, and 121K perform development for colors of yellow, cyan, magenta, and black, respectively. Although using different toner colors, these devices are identical in configuration, and therefore the configuration of the image forming device 121K is explained as a typical configuration among the image forming devices 121Y, 121C, 121M, and 121K.

Figure 2:
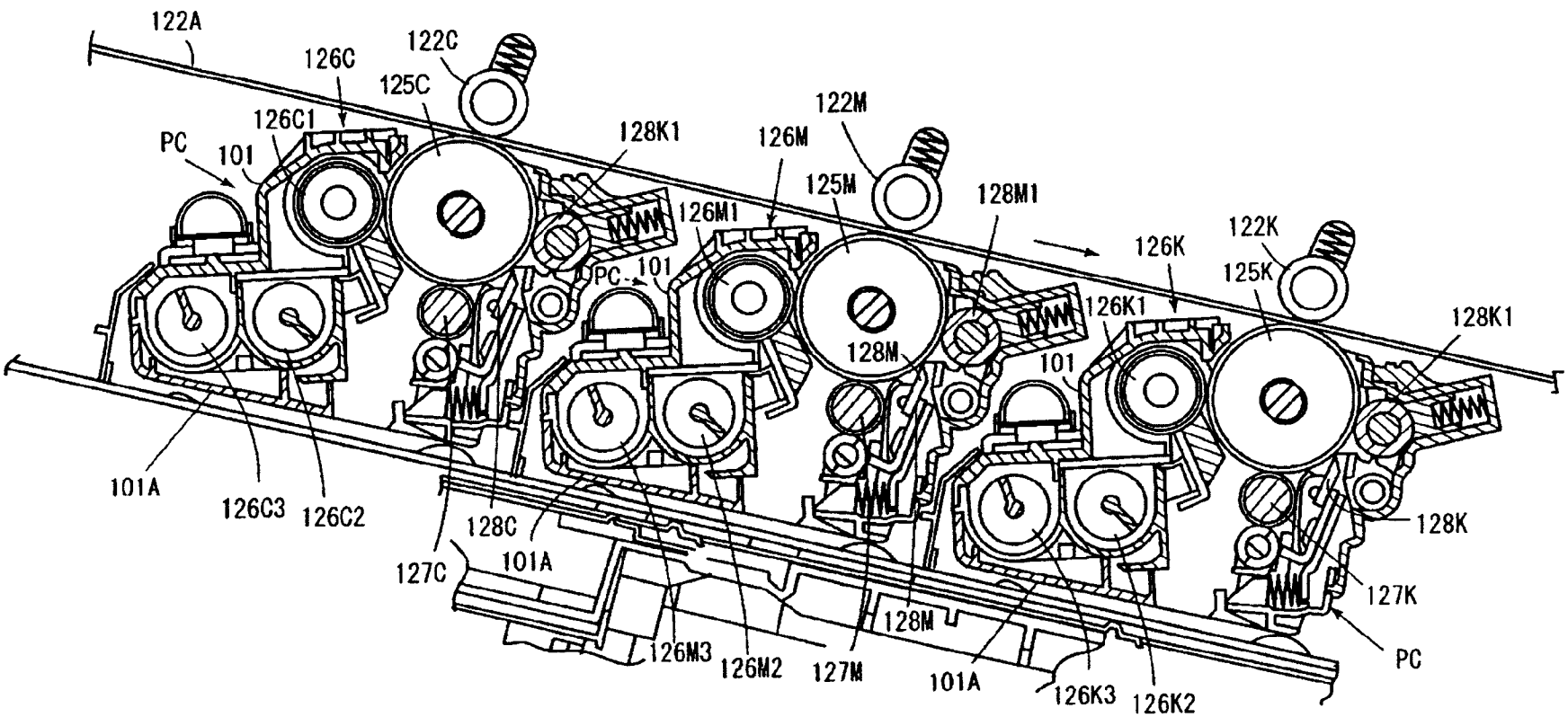
FIG. 2 is a schematic diagram of a developing device shown in FIG. 1.

As shown in FIG. 2, the image forming device 121K includes a photosensitive drum 125*k* as an image carrier, and also includes a charging device 127K, a developing device 126, and a cleaning device 128K arranged in this order along a rotating direction of the photosensitive drum 125. Between the charging device 127K and the developing device 126K, an electrostatic latent image according to image information corresponding to the color obtained through color separation by writing light 129K from a writing device 129 (refer to FIG. 1) is formed. The cleaning device 128K includes, in addition to a known cleaning blade, a lubricant applying mechanism 128K1 for increasing foreign-matter removal efficiency.

As an image carrier, a belt-shaped member may be used in place of a drum-shaped member. Devices for image formation disposed around these photosensitive drums are collectively accommodated in a process cartridge (represented as a reference character PC for convenience) having a unit structure provided with a box as shown in FIG. 2.

In the image forming apparatus 120, one of the rollers over which the transfer belt 122A for use in the transfer device 122 is spread (the roller represented by a reference character 122A1 in FIG. 1) has an axial center taken as a base point, and the transfer device 122 is tilted so that a downstream side in a direction in which an extension surface of the transfer belt 122A facing the image forming devices 121Y, 121C, 121M, and 121K moves is positioned lower than an upstream side, that is, the position of the roller 122A1. With this, the occupied space of the transfer device 122 in the lateral direction is reduced to downsize the image forming apparatus.

In the image forming apparatus 120 having the configuration explained above, image formation is performed through the following processes and conditions. In the following explanation, the image forming device 121K for image formation using black toner is explained as a representative of the image forming devices, and it is assumed that this explanation can similarly apply to the other image forming devices.

At the time of image formation, the photosensitive drum 125K is driven for rotation by a main motor not shown, and is subjected to static elimination by an alternating-current (AC) bias applied to the charging device 127K (with 0 direct-current (DC) component), with its surface potential being set at a reference potential of approximately −50 volts.

Next, the photosensitive drum 125K is applied with a DC bias having superposed thereon an AC bias on the charging device 127K, thereby being uniformly charged at a potential approximately equal to that of the DC component, and its surface potential is charged at approximately −500 volts to −700 volts (a target charge potential is determined by a process controlling unit).

After the photosensitive drum 125 is uniformly charged, a writing process is carried out. An image to be written is written by using the writing device 129 according to digital image information from a controller unit not shown for forming an electrostatic latent image. That is, in the writing device 129, laser light from a light source that emits light based on a light emitting signal for laser diode binarized for each color corresponding to the digital image information is applied through a cylinder lens (not shown), a polygon mirror 129A, an fθ lens 129B, first to third mirrors, and a WTL lens onto the photosensitive drum that carries an image for a relevant color, in this case, the photosensitive drum 125K, for convenience. With this, the surface potential of a light-applied portion on the surface of the photosensitive drum becomes approximately −50 volts, thereby forming an electrostatic latent image corresponding to the image information.

The electrostatic latent image formed on the photosensitive drum 125K is subjected to a visible image process by the developing device 126K using a toner having a complementary color relation with the color obtained through color separation. In the developing process, DC with an AC bias superposed on a developing sleeve of −300 volts to −500 volts is applied, thereby developing the toner only in an image portion with its potential being decreased due to radiation with writing light (Q/M: −20 to −30 μC/g) to form a toner image.

The toner images of the respective colors subjected to a visible image process through the developing process are transferred to the recording medium let out with its resist timing being set by the resist roller 130. The recording medium is electrostatically attached to the transfer belt 122A with application of a bias for attachment by a bias unit for sheet attachment formed of a roller before the recording medium reaches the transfer belt 122A.

The transfer belt 122A has electrostatically transferred thereon the toner images from the photosensitive drums through application of a bias with a polarity reverse to that of the toner by the relevant one of the transfer bias units 122Y, 122C, 122M, and 122K included in the transfer device 122 at a position facing to the photosensitive drum in each image forming device. The superposed and transferred toner images are then collectively transferred to the recording medium by the secondary transfer bias unit 122F.

The recording medium having the images of the respective colors collectively transferred thereto is self-stripped from the transfer belt 122A by using an edge-surface curvature of a roller on a side facing to the secondary transfer bias unit 122F from among rollers of the transfer belt unit, and is then conveyed toward the fixing device 110. With the recording medium passing through the fixing nip formed of the fixing belt and the pressure roller, the toner image is fixed to the recording medium, and then the recording medium is delivered to a paper delivery tray 132.

In the image forming apparatus 120, not only image formation on one side of the recording medium to be delivered after fixing but also image formation on both sides thereof can be performed. At the time of image formation on both sides, the recording medium after fixing is conveyed to a reverse circulation route RP, and is let out by a supply roller RP1 toward the resist roller 130, the supply roller RP1 being positioned at an end of this circulation route to serve also as a sheet supplying unit from a feeding tray. Switching the conveying route for the recording medium between image formation on one side and image formation on both sides is performed by a conveyor route switching nail (not shown) disposed in a rearward position of the fixing device 110.

Being used for the image forming apparatus 120 having the configuration as explained above, the developing device 126K that brings the developer in contact with the photosensitive drum 125K includes, as shown in FIG. 2, a developer housing 101A forming a developer container in a box 101 forming the process cartridge PC. In the developer housing 101A, rotatable first and second screws 126K2 and 126K3 are used as first and second developer conveyor members in the order near a developing roller 126K1.

The first and second screws have their rotating directions being set in reverse so as to be able to stir the developer in reverse directions in the developer housing 101A for transport (conveyance).

Figure 3:
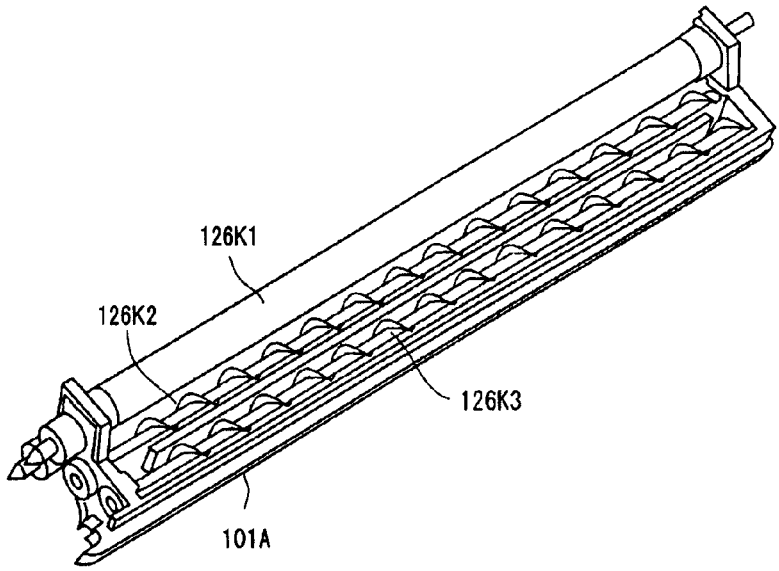
FIG. 3 is a perspective view of relevant part of the developing device.

Of these screws, the first screw 126K2 is used to supply the developer to the developing roller 126K1, whilst the second screw 126K3 is used for stirring a new toner of black supplied from a relevant one of supply toner tanks represented by reference characters T1 to T4 in FIG. 1 and a carrier for friction charge on the toner. FIG. 3 is a perspective view of relevant part of the developing device 126K. The first and second screws 126K2 and 126K3 can be drive-controlled independently.

Figure 4:
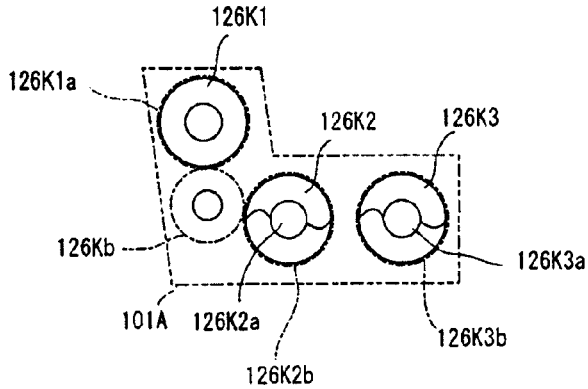
FIG. 4 is a side view for explaining a driving system of the developing device.

FIG. 4 depicts a mechanism for independent drive control. In FIG. 4, the developing roller 126K1 and the first screw 126K2 are driven by the same driving source and the second screw 126K3 is driven by using a driving source different from that on the side of the developing roller 126K1 and the first screw 126K2. That is, in FIG. 4, a drive-side gear 126K1*a* provided to a rotational shaft of the developing roller 126K1 operates in conjunction with a driven-side gear 126K2*b* provided to a rotational shaft 126K2*a* of the first screw 126K2 via an idle gear 126Kb. On the other hand, a gear 126K3*b* provided to a rotational shaft 126K3*a* of the second screw 126K3 is driven by an independent drive motor (not shown).

Figure 5:
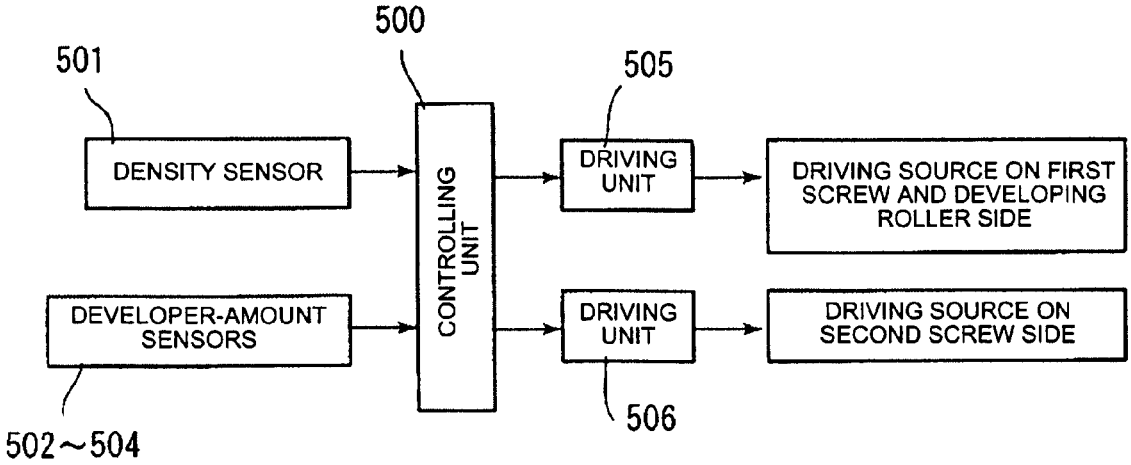
FIG. 5 is a block diagram of a controlling unit of the developing device.

The first and second screws 126K2 and 126K3 are drive-controlled independently. Therefore, as for the rotation speed, the absolute speed of the second screw 126K3 can be changed. That is, the driving sources of the first and second screws 126K2 and 126K3 have their rotation speeds set independently by a controlling unit 500 shown in FIG. 5.

The controlling unit 500 is a unit that executes sequence programs, such as those for setting image forming conditions including toner supply control through image density detection. The controlling unit 500 has its input side to which a density sensor 501 for detecting a density of a density-detection test pattern formed on the photosensitive drum 125K and developer-amount sensors 502 to 504 provided at a developer container are connected and its output side to which driving units 505 and 506 as driving sources forming supply amount adjusting units for the first and second screws 126K2 and 126K3 are connected.

For the density sensor 501, a light-receiving sensor capable of detecting reflected light from the density-detection test pattern formed on a non-image portion of the photosensitive drum 125K is used for supplying toner to the developer, controlling a developing bias that defines an image formation condition, and others according to the detection result.

Figure 6:
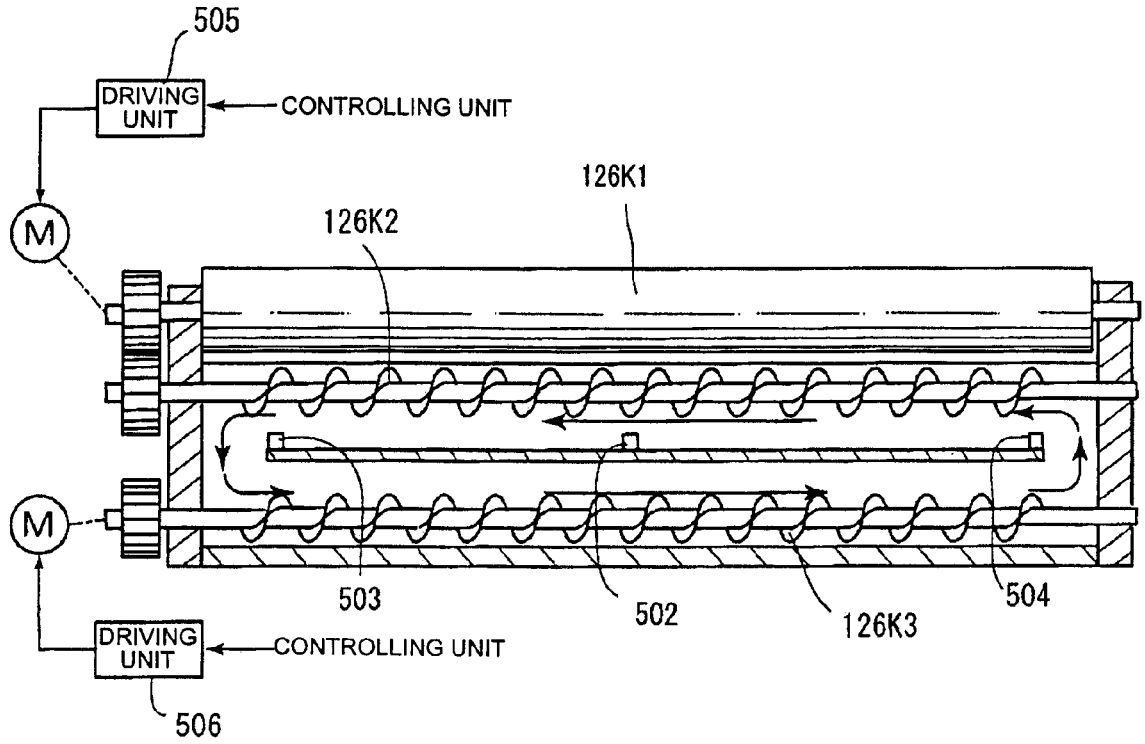
FIG. 6 is a schematic diagram for explaining sensors shown in FIG. 5.

The developer-amount sensors 502 to 504 are provided, as shown in FIG. 6, to a plurality of positions corresponding to the center in an axial direction parallel to an extending direction of the developing roller 126K1, that is, in an axial direction in the first and second screws parallel to an axial direction of the developing roller 126K1, and positions near image-area boundaries other than the center. These set-up positions correspond to the center of the image area in a horizontal direction and both boundary ends thereof.

In the controlling unit 500, the developer-amount sensors 502 to 504 each detect a height of the developer surface (corresponding to a draught surface) on the first screw 126K2 side in the developer container at arbitrary timing to find a developer amount. Based on the result of comparison between the detection result and a predetermined value, a threshold, the rotation speed of the second screw 126K3 is changed.

That is, when the height of the developer surface on the first screw 126K2 side is below the threshold, it is determined that the developer amount is small on the first screw 126K2 side, and the absolute speed of the second screw 126K3 is increased to correct this situation. With this, the developer amount transported to the first screw 126K2 is increased, thereby increasing the height of the developer on the first screw 126K2.

Conversely, when the height of the developer surface is above the threshold, it is determined that the developer amount is large, and the absolute speed of the second screw 126K3 is decreased. With this, the developer amount on the first screw 126K2 side is made appropriate.

According to the first embodiment, the first and second screws 126K2 and 126K3 are drive-controlled independently at arbitrary timing. Therefore, such control may be performed at the time of developing operation. Thus, unlike the case where independent control is performed only during periods other than the period of developing operation, the balance of the developer supply amount can always be made appropriate. This is also true for the case in comparison with the configuration in which the rotation speed is changed between the screws only at the time of starting up the image forming apparatus. Therefore, unlike such conventional independent control, the developer supply balance can also always be monitored, and control can be performed based on the monitoring result. Thus, the occurrence of an abnormal image because the developer supply balance is disturbed and the occurrence of density unevenness between right and left of the image area can be prevented. Furthermore, the configuration for stabilizing the developer supply amount, that is, the configuration for keeping the balance of the supply amount between the first and second screws, can be achieved without additional providing a special member or device but only using the existing components, that is, the screws and their driving sources and the driving unit as a unit of adjusting the driving sources.

EXAMPLES

Tests are conducted under the following conditions:

(A) Linear velocity of the photosensitive drum: 180 mm/sec (B) Linear velocity ratio between the photosensitive drum and the developing roller: variable range of 0.5 to 3.0

(C) Development gap: variable range of 0.25 millimeters to 0.50 millimeters (D) Carrier for use: Iron powder carrier having a mass average particle diameter of 35 micrometers (E) Toner density of the developer: approximately 7 weight percent (F) Developing bias: DC bias

Example 1

Figure 7:
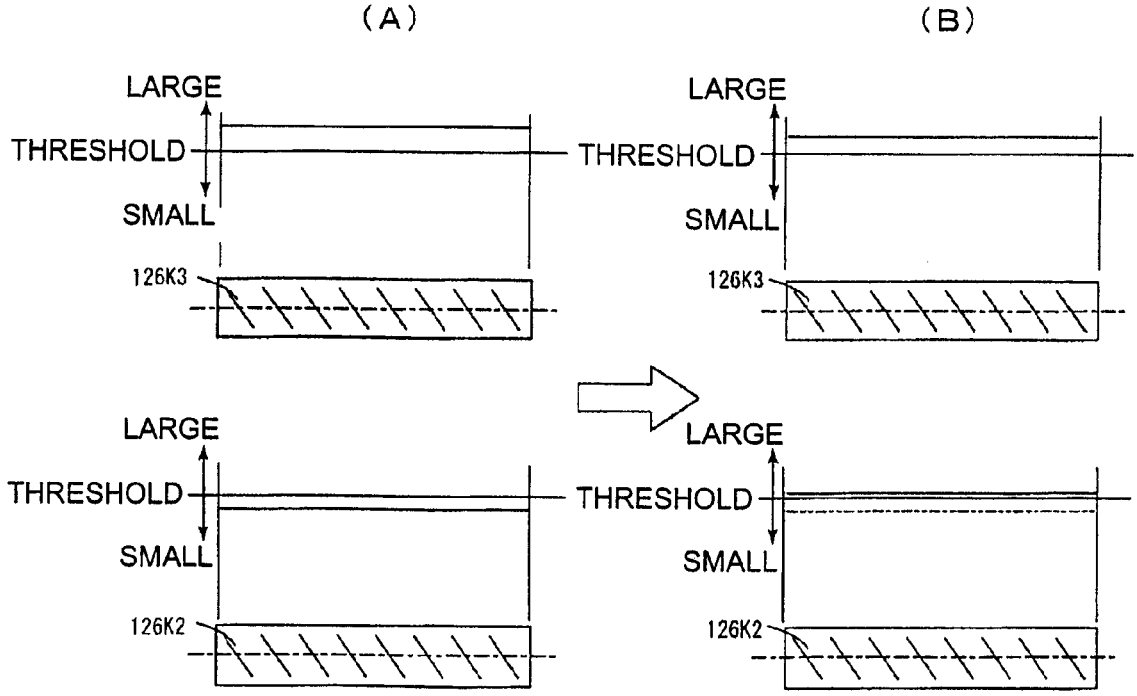
FIGS. 7 and 8 are schematic diagrams for explaining changes in the amount of developer.

FIG. 7 is a schematic diagram for explaining change in the amount of developer in Example 1. Specifically, FIG. 7 depicts a state before the rotation speed of the second screw 126K3 is changed (A), and a state after the rotation speed of the second screw 126K3 is changed (B).

In FIG. 7, a line of "threshold" indicates a developer supply distribution. When the developer contained in the developer container on the first screw 126K2 side is shifted to the developer container at which the second screw 126K3 is positioned (FIG. 7(A)), an entire solid image with the entire image area being taken as an image portion (a solid image formed in this case is hereinafter referred to as an image A) is formed. It is assumed in this case that the developer is not shifted in a horizontal direction of the image area (the state where the developer amount is not shifted in a horizontal direction with reference to the threshold in FIG. 7A).

Next, the rotation speed of the second screw 126K3 is increased to continue transport of the developer until all of the developer-amount sensors 502 to 504 provided for the first screw 126K2 detect the threshold. At this time, as with the case explained above, an entire solid image is formed (this image is hereinafter referred to as an image B).

The inventors compared the image densities of the images A and B to obtain the result of improvement such that the ID (image density) of the image A was 0.8, whilst the ID of the image B was 1.5. The inventors also confirmed that screw pitch unevenness or the like did not occur (FIG. 7 (B)). It can be seen that, by increasing the supply amount from the second screw 126K3, the uniform amount of developer becomes present over the entire image area of the first screw 126K2. Note that a two-dot chain in (B) of FIG. 7 represents the developer amount shown in (A) of FIG. 7.

Example 2

Figure 8:
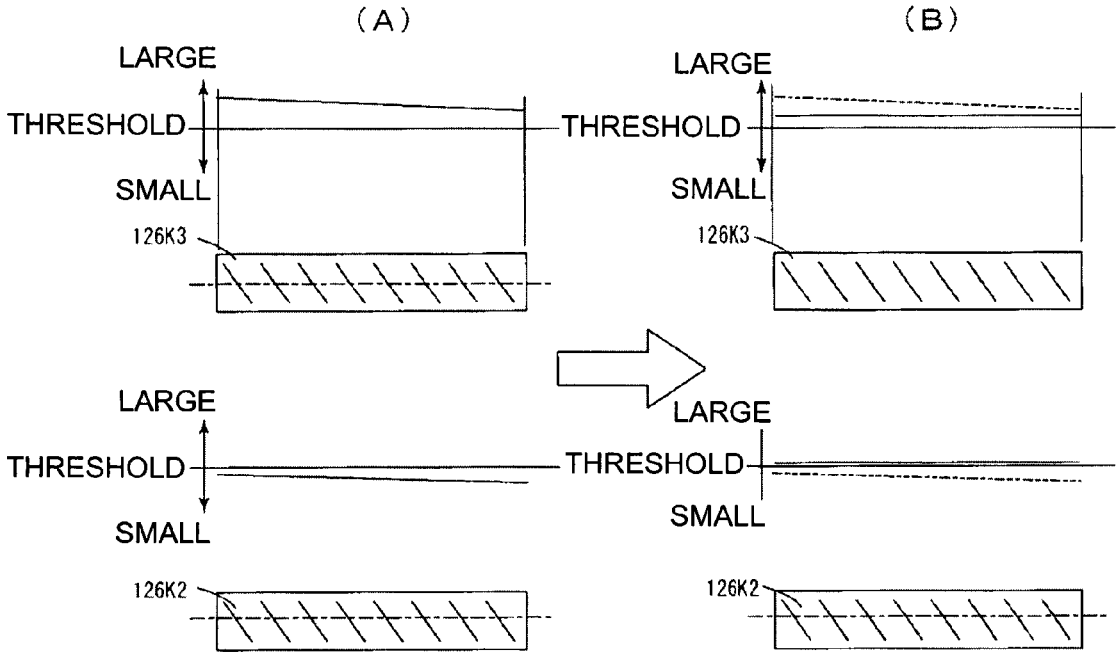

FIG. 8 is a schematic diagram for explaining change in the amount of developer in Example 2. Specifically, FIG. 8 depicts a state before the rotation speed of the second screw 126K3 is changed (A) and a state after the rotation speed of the second screw 126K3 is changed (B). In FIG. 8, as in FIG. 7, a line of "threshold" indicates an amount of developer.

FIG. 8 depicts a case where the developer amount in a horizontal direction of the image area is shifted. When, with the right side of FIG. 8 representing a back side of the developing roller 126K and the left side representing a front side thereof, the image density on the back side is lower than that on the front side (FIG. 8 (A)), an entire solid image similar to that in the case of FIG. 7 is formed (this image is hereinafter referred to as an image C).

Next, with the rotation speed of the second screw 126K3 being decreased, the rotation is kept until the developer amount on the first screw 126K2 side reaches the threshold to form an entire solid image (this image is hereinafter referred to as an image D).

In comparison of image density between the images C and D obtained under the both conditions, as shown in (B) of FIG. 8, the transport amount is shifted from the front side to the back side of the image area at the second screw 126K3 through a decrease in rotation speed of the second screw 126K3, thereby eliminating unevenness of the developer on the entire image area. The improved result was obtained such that, while the IDs (image densities) of the image C were 1.5 on the front side and 1.0 on the back side, the IDs of the image D were 1.5 on both of the front and back sides. With this, the developer amounts in the horizontal direction of the image area, that is, on the back and front sides, were able to be equalized to improve the image density. Note that a two-dot chain in (B) of FIG. 8 represents the developer amount shown in (A) of FIG. 8.

Therefore, according to the embodiment, with rotatable screws being used as first and second developer supplying units, the occurrence of an abnormal image can be prevented through a simple control of only changing the rotation speed with the use of the existing developer-supply components without adding a special structure.

Also, the controlling unit having provided on its input side a density detecting unit that detects a density of a visible image subjected to a visible image process by the developing roller controls the first and second developer supplying units independently. With this, the occurrence of an abnormal image can be prevented according to changes in the state of image density.

Furthermore, a sensor that detects a developer amount in the developer container is provided for each of the positions near the center and both boundary ends of the image area. Therefore, by detecting the developer amount in the entire image area to detect an uneven state of the developer in the image area, the uneven state can be eliminated.

Still further, with such a developing device being incorporated in an image forming apparatus, the occurrence of an abnormal image can be prevented by making the developer supply balance appropriate.

Figure 9:
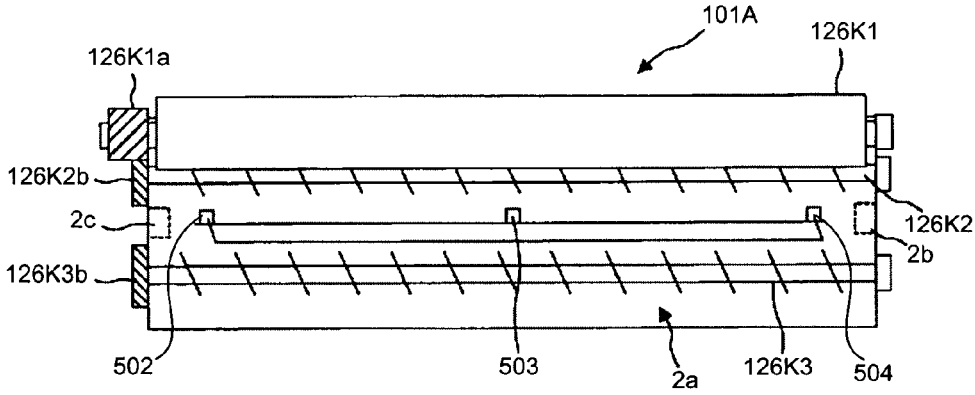
FIG. 9 is a schematic diagram of a developing device according to a second embodiment of the present invention.

FIG. 9 is a schematic diagram of a developing device according to a second embodiment of the present invention. According to the second embodiment, the problems in the developing device explained above can be avoided.

Specifically, the first screw (first shaft) 126K2 and the second screw (second shaft) 126K3, which have been driven simultaneously, are driven independently, and the rotation speed of the second screw 126K3 is changed according to the developer amount of the first screw 126K2, thereby making it possible to always keep the developer amount at one shaft appropriate.

In a developing device of FIG. 9, the developing roller 126K1 receives mobile power via the drive transmission gear 126Kb receiving drive power from the image forming apparatus body (FIG. 1) via the drive gear 126K1*a* mounted at one end of the developing roller 126K1 and, via the drive transmission gear 126Kb, further transfers the mobile power to the gear 126K2*b* of the first screw 126K2 as a first rotator. The developing roller 126K1 and the first screw 126K2 are driven simultaneously.

The second screw 126K3 as a second rotator having the drive gear 126K3*b* is driven by a driving unit not shown independently of the developing roller 126K1 and the first screw 126K2, and can be rotated at a speed different from the speed of the developing roller 126K1 and the first screw 126K2.

As shown in FIG. 9, the developing device is provided with a (variable) first adjusting unit 2*b* that deforms so as to adjust the capability of supplying the developer from the first screw 126K2 disposed near the developing roller 126K1 to the second screw 126K3 disposed at a position away from the developing roller 126K1 by a distance longer than a distance between the first screw 126K2 and the developing roller 126K1, and a second adjusting unit 2*c* that deforms so as to adjust the capability of supplying the developer from the second screw 126K3 to the first screw 126K2.

Near the first screw 126K2 in a developer container 2*a*, the developer-amount sensors 502 to 504 are mounted for measuring and detecting the developer amount, and sample a draught surface (height of the developer surface) of the developer of the first screw 126K2 at an arbitrary cycle.

For example, if the draught surface of the developer is below a certain threshold, it is determined that the developer amount of the first screw 126K2 is small, and the rotation speed of the second screw 126K3 is increased in order to increase the developer on the first screw 126K2. With that, the developer on the second screw 126K3 side flows into the first screw 126K2 side, thereby increasing the height of the draught surface of the developer on the first screw 126K2 side.

Conversely, if the draught surface of the developer is above a certain threshold, it is determined that the developer amount of the first screw 126K2 is large, and the rotation speed of the second screw 126K3 is decreased. In this manner, through adjustment as appropriate so that the developer amount of the first screw 126K2 (first shaft) is appropriate, an excellent image can be obtained over a period of time without a decrease in ID, screw-pitch unevenness, image density deviation in a horizontal direction, or others.

In the second embodiment, a threshold of the developer amount on the first screw 126K2 side is provided, and the rotation speed of the second screw 126K3 is changed when the developer amount is below or above the threshold. When the developer amount on the first screw 126K2 side is desired to be changed successively, the rotation speed of the second screw 126K3 can be changed successively based on the values read by the developer-amount sensors 502 to 504.

Other schemes for changing the capability of supplying the developer between the first screw 126K2 and the second screw 126K3 include changing the opening size of an opening between the first screw 126K2 and the second screw 126K3 and changing a height position of the screw.

Figure 10:
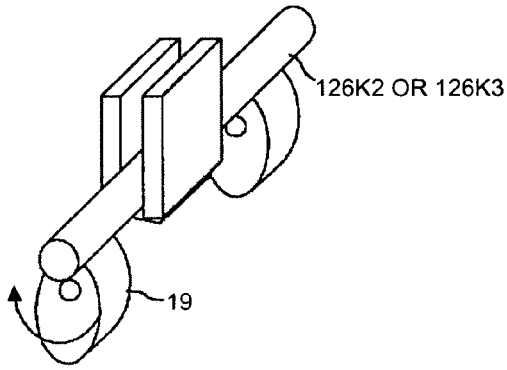
FIG. 10 is a perspective view of a first screw or a second screw moved upward or downward to change height positions of the screws.

FIG. 10 is a schematic diagram for explaining change in screw-height position by vertically moving the first or second screw. In the second embodiment, to change the height position of the developer conveyor screws 126K2 or 126K3 (first or second screws 126K2 and 126K3), cams 19 that rotates using an appropriate scheme are disposed under the first screw 126K2 or the second screw 126K3 so as to vertically move the screw. The capability of supplying the developer at this time is determined by a height position of the developer conveyor screw and a height of the developer.

Figure 11:
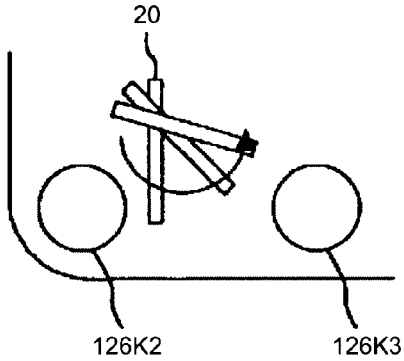
FIG. 11 is a schematic diagram of a partition plate that swings to open and close an opening.

FIG. 11 is a schematic diagram of a partition plate that swings to open and close an opening. As shown in FIG. 11, a partition plate 20 capable of swinging is provided between the first screw 126K2 and the second screw 126K3 at a position where an opening (not shown) can be open or closed. The partition plate 20 is swung as required to open and close the opening.

Figure 12:
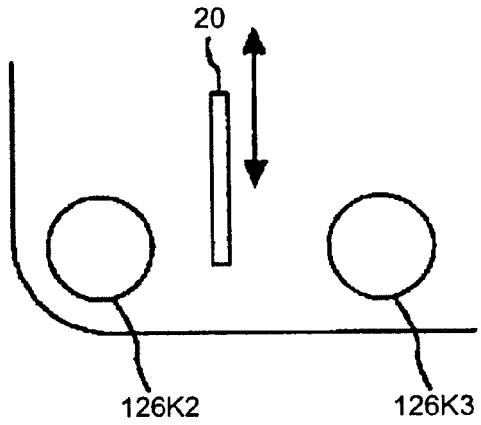
FIG. 12 is a schematic diagram of a partition plate that vertically moves to open and close the opening.
Figure 13:
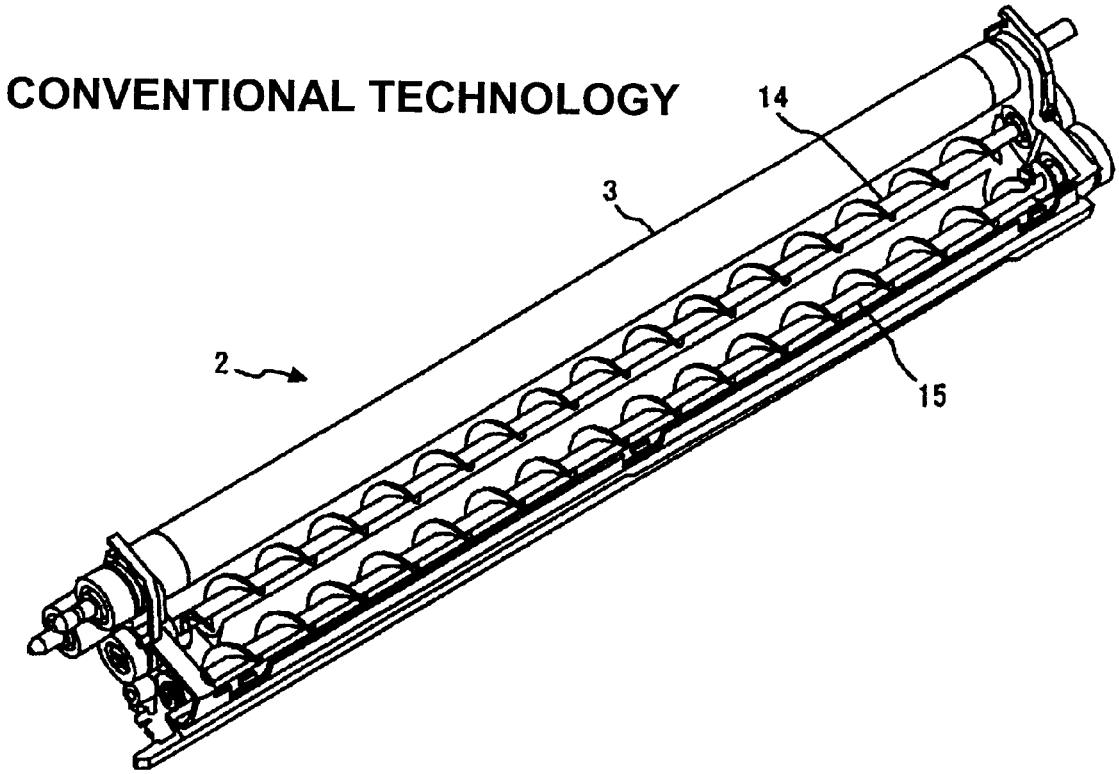
FIG. 13 is a schematic diagram of a general developing device of a two-component developing system.

FIG. 12 is a schematic diagram of a partition plate that vertically moves to open and close the opening. As shown in FIG. 12, the partition plate 20 provided between the first screw 126K2 and the second screw 126K3 is moved vertically by an appropriate mechanism in a longitudinal direction not shown, thereby achieving opening and closing the opening (not shown). Although not shown, the opening and closing method and direction of the partition plate can be changed for each of the first and second adjusting units.

A test was conducted by using an image forming apparatus having a photosensitive drum in which a two-component developer was conveyed and developed by a developing roller including a fixed magnet roller and the developing bias was DC under the following conditions:

- Liner velocity of the photosensitive drum: 180 mm/sec
- Linear velocity ratio between the photosensitive drum and the developing roller: variable range of 0.5 to 3.0
- The amount of drawing up the developer by the developing roller: 55 to 60 mg/cm$^2$
- Development gap: variable range of 0.25 millimeters to 0.50 millimeters
- Carrier: Iron powder carrier having a mass average particle diameter of 35 micrometers
- Toner density of the developer: approximately 7 weight percent
- Developing bias: DC bias In Example 1, the developer in the developer container on the first screw 126K2 (FIG. 9) side was shifted to the developer container on the second screw 126K3 (FIG. 9) side, and then the entire solid image A was output.

Next, the rotation speed of the second screw 126K3 was increased, and an amount of the developer in the developer container on the first screw 126K2 side is increased until the values of the three developer-amount sensors 502 to 504 (FIG. 9) (one disposed at each of the positions near both boundaries of the image area in a horizontal direction and one disposed at a position near the center of the developing roller) become a threshold specified in advance. However, no deviation in developer amount was provided in the horizontal direction. Then, the entire solid image B was output.

The number of developer-amount sensors is cited by way of example and without limitation, and any number of sensors can be utilized.

As a result of measurement of the output images A and B, the image A had an ID of 0.80 with the occurrence of screw pitch unevenness, whilst the image B had an ID of 1.50 without the occurrence of screw pitch unevenness. This indicates that the occurrence of screw pitch unevenness and reduction in ID do not occur if the developer amount on the first screw 126K2 side is above the certain threshold, but image quality is significantly degraded if the developer amount is below the threshold.

In the second embodiment, a deviation in ID between right and left sides was produced due to a factor other than a factor associated with the developing device, and the entire solid image C was output with its ID on the back side lower than that on the front side. Next, the rotation speed of the second screw 126K3 (FIG. 9) was decreased to shift the developer in the developer container on the first screw 126K2 (FIG. 9) side from the front side to the back side until the values of the three developer-amount sensors 502 to 504 (FIG. 9) became the threshold specified in advance to output the entire solid image D.

Then, as a result of measurement of the output images C and D, the image C had an ID on the front side of 1.5 and an ID on the back side of 1.0, whilst the image D had an ID on the front side of 1.5 and an ID on the back side of 1.5. As such, the deviation of the right and left IDs was improved.

As set forth hereinabove, according to an embodiment of the present invention, the supply amount of the first and second developer supplying units can be controlled independently. Therefore, a shortage of developer at the first developer supplying unit can be solved, and also a state in which the supply amount is uneven over the entire supply area can be solved. Therefore, by preventing deterioration in image density due to a decrease in the amount of drawing up the developer and preventing the occurrence of unevenness in density on the right and left sides of the image area, the occurrence of an abnormal image can be avoided in advance.

Moreover, the developer can be shifted to the photosensitive member side, that is, the developing roller side. Therefore, a decrease in image density in association with a decrease in the drawn-up amount due to supply shortage of the developer to the developer can be prevented. Furthermore, reduction in screw pitch unevenness due to unevenness of the developer supplied to the developing roller.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device, comprising:

a developer container that contains a two-component developer including a carrier and a toner attached to the carrier through a frictional electrification;

a developing roller that supplies the two-component developer from the developer container to an image carrier;

a first developer supplying unit; and a second developer supplying unit that is aligned with the first developer supplying unit and located more distant from the developing roller than the first developer supplying unit is from the developing roller, wherein the first developer supplying unit and the second developer supplying unit circularly convey the two-component developer while stirring the two-component developer to supply the two-component developer to the developing roller, and an absolute rotation speed of the second developer supplying unit is changeable without a change in a rotation speed of the developing roller and the first developer supplying unit.

2. The developing device according to claim 1, wherein the first developer supplying unit and the second developer supplying unit are rotating members, the developing device further comprising:

a first adjusting unit configured to adjust the rotation speed of the first developer supplying unit; and a second adjusting unit configured to adjust the absolute rotation speed of the second developer supplying unit.

3. The developing device according to claim 2, further comprising:

a controlling unit that is connected to the first adjusting unit and the second adjusting unit, and is configured to change an amount of the two-component developer to be supplied at a predetermined timing; and a density sensor that is located on an input side of the controlling unit and detects a density of a visible image formed by the developing roller.

4. The developing device according to claim 3, further comprising:

a developer-amount sensor that is located on the input side of the controlling unit and detects an amount of the two-component developer contained in the developer container.

5. The developing device according to claim 4, wherein the developer-amount sensor includes a plurality of developer-amount sensors, and at least one of the developer-amount sensors is located at a center in a direction in which the first developer supplying unit and the second developer supplying unit extend.

6. The developing device according to claim 5, wherein the developer-amount sensors are located near both boundary edges of an image area in an axial direction of the developing roller and at a center of the image area corresponding to a center of the developing roller in the axial direction.

7. The developing device according to claim 4, wherein the controlling unit is configured to control the first adjusting unit and the second adjusting unit based on a detection result obtained by the developer-amount sensor.

8. An image forming apparatus comprising the developing device according to claim 1.

9. A developing device, comprising:

a developer container that contains a two-component developer including a carrier and a toner attached to the carrier through a frictional electrification;

a developing roller that supplies the two-component developer from the developer container to an image carrier;

a first screw that circularly conveys the two-component developer while stirring the two-component developer to supply the two-component developer to the developing roller; and a second screw that circularly conveys the two-component developer while stirring the two-component developer to supply the two-component developer to the developing roller, the second screw being aligned with the first screw and located more distant from the developing roller than the first screw is from the developing roller, wherein an absolute rotation speed of the second screw is changeable without a change in a rotation speed of the developing roller and the first screw.

* * * * *